US005201951A

United States Patent [19]

Shigeta

[11] Patent Number: 5,201,951

[45] Date of Patent: Apr. 13, 1993

[54] DEVICE FOR COATING A PHOTOSENSITIVE FILM ON A PLATE ROLL

[75] Inventor: Tatsuo Shigeta, Nagareyama, Japan

[73] Assignee: Think Laboratory Co., Ltd., Chiba, Japan

[21] Appl. No.: 818,926

[22] Filed: Jan. 10, 1992

[30] Foreign Application Priority Data

Jun. 1, 1991 [JP] Japan ..... 3-157792

[51] Int. Cl.[5] ..... B05C 9/10; B05C 1/08

[52] U.S. Cl. ..... 118/73; 118/75; 118/218; 118/232; 118/242; 118/DIG. 11; 118/705; 15/88; 15/304; 15/4

[58] Field of Search ..... 118/73, 75, 216, 218, 118/232, 241, 242, 252, 321, DIG. 11, 500, 501, 705; 15/88, 304, 4

[56] References Cited

U.S. PATENT DOCUMENTS

| | | | |
|---|---|---|---|
| 3,951,103 | 4/1976 | Hinchcliffe et al. | 118/321 |
| 3,952,698 | 4/1976 | Beyer et al. | 118/73 |
| 3,999,239 | 12/1976 | Misuna | 15/88 |
| 4,036,168 | 7/1977 | Laliberte et al. | 118/73 |
| 4,051,805 | 10/1977 | Waldrum | 118/73 |
| 4,067,293 | 1/1978 | Probst | 118/73 |
| 4,294,533 | 10/1981 | Bratt et al. | 118/73 |
| 4,368,240 | 1/1983 | Nauta et al. | 118/321 |
| 4,745,004 | 5/1988 | Schwerin | 118/73 |

FOREIGN PATENT DOCUMENTS

| | | | |
|---|---|---|---|
| 2839217 | 4/1979 | Fed. Rep. of Germany | 118/321 |

*Primary Examiner*—W. Gary Jones
*Assistant Examiner*—Todd J. Burns
*Attorney, Agent, or Firm*—Koda and Androlia

[57] ABSTRACT

A plate making device for a plate roll that is to be made into a printing plate in which a pretreatment assembly, a photosensitive film coating assembly, and a protective film coating assembly are respectively installed on three separate tables that can be raised and lowered relative to the plate roll. The three separate tables are provided on a common table that is slidable along the axis of the plate roll. The three separate tables and the common table are moved so that a pretreatment assembly, a photosensitive film coating assembly and a protective film coating assembly are successively come into contact with the plate roll, and a pretreatment, a photosensitive film coating and a protective film coating are successively performed on the plate roll by the pretreatment assembly, the photosensitive film coating assembly and the protective film coating assembly. Thus, the entire plate making processes is performed by a single device, occupying lesser spaces.

8 Claims, 4 Drawing Sheets

DEVICE FOR COATING A PHOTOSENSITIVE FILM ON A PLATE ROLL

BACKGROUND OF THE INVENTION

1. Field of the Invention

The present invention relates to a device for coating a photosensitive film on a printing plate shaped in a roll (hereinafter called a "plate roll") and more specifically to a device wherein a pretreatment, a photosensitive film coating treatment and a protective film coating treatment are successively performed on the plate roll by a single device.

2. Prior Art

Generally, in a plate making process for a plate roll, steps of BALLARD COPPER plating, buffing, pretreatment, photosensitive film coating, protective film coating, argon ion laser exposure, development, etching, resist stripping, and chrome plating are performed in the order listed.

In the plate making processes described above, the protective film coating is performed for the following reasons: since the photosensitive film uses an ultra-high-sensitivity photosensitive agent which can be exposed by means of an argon ion laser, the photosensitive film is susceptible to oxidation in a short time following the coating. If the photosensitive film is oxidized, the film loses its photosensitivity. Furthermore, if the photosensitive film is exposed in the open air, the oxygen in the air hinders the photosensitive performance of the photosensitive agent.

As is mentioned above, plate making process is comprised of several different steps, and these steps are performed by devices which are lined up independently.

In other words, to make a plate roll, several devices are required. Therefore, the conventional devices occupy large spaces, and the cost of the devices used for plate making are high. Furthermore, handling of the product between the various devices requires considerable time and labor. Moreover, since the pretreatment is conventionally performed by hand, it is desirable that the pretreatment is integrated with the photosensitive film coating device.

SUMMARY OF THE INVENTION

Accordingly, the object of the present invention is to provide a photosensitive film coating device for plate rolls, in which a pretreatment, a photosensitive film coating treatment and a protective film coating treatment are successively performed on the plate roll by means of a single device.

As a means to solve the above described problems, the present invention provides a photosensitive film coating device for plate rolls, which is characterized by the fact that:

a plate roll is held and rotated by a roll chucking means that is comprised of a spindle chuck, a tail chuck, and motors, and the plate roll is treated by a multi-treatment-means comprised of a pretreatment means, a photosensitive film coating means and a protective film coating means which are respectively provided on three separate table devices that can be raised and lowered relative to the plate roll.

The three separate table devices are installed on a common table which is provided on a flame of the photosensitive film coating device so as to be slid along the axis of the plate roll, wherein the pretreatment means includes a cleaning means, a rinsing means, and a moisture removal means, so that the pretreatment means consecutively cleans the plate roll, rinses the plate roll, and then removes moisture from the plate roll, the photosensitive film coating means consists of a photosensitive film coating roll and a photosensitive liquid tank, so that the photosensitive film coating means applies photosensitive liquid on the plate roll following the pretreatment operation performed by the pretreatment means, and the protective film coating means consists of a protective film coating roll and a protective liquid tank, so that the protective film coating means applies protective liquid on the plate roll following a photosensitive liquid coating operation performed by the photosensitive film coating means.

In the photosensitive film coating device described above:

the plate roll is first horizontally held by the chuck means and rotated at a predetermined speed, the separate table including the pretreatment means is raised so that the first brush of the pretreatment means contact with the surface of the plate roll, the common table then slides along the axis of the plate roll.

As a result, the second brush and the sponge roll consecutively come into contact with the surface of the plate roll. The cleaning, the rinsing and the moisture removing are thus performed successively.

After the pretreatment is thus finished, the separate table including the pretreatment means is lowered, and the common table is reversely slid so that the common table reaches at the initial position of the photosensitive film coating.

Next, the separate table including the photosensitive film coating means is raised to the plate roll so that the photosensitive film coating roll contacts the surface of the plate roll, and the common table is slid in the axial direction of the plate roll.

As a result, a photosensitive film is applied on the surface of the plate roll. After the photosensitive film coating is finished, the separate table including the photosensitive film coating is lowered, and the common table is reversely slid so that the common table reaches at the initial position of the protective film coating.

Next, the separate table including the protective film coating is raised to the plate roll so that the protective film coating roll contacts the surface of the plate roll, and the common table is slid along with the axis of the plate roll.

As a result, a protective film is applied on the surface of the plate roll. After the protective film coating is finished, the separate table including the protective film coating is lowered, and the common table is reversely slid so that the common table reaches at the initial position of the pretreatment.

As is mentioned above, three different steps of the plate making process are performed by a single device. Thus, the plate roll making device of the present invention does not occupy large spaces. Furthermore, handling of the products between the devices can be decreased, so that the plate roll is made at a low price.

DETAILED DESCRIPTION OF THE INVENTION

Below, an embodiment of the present invention will be described with reference to the attached drawings.

Figure 1:
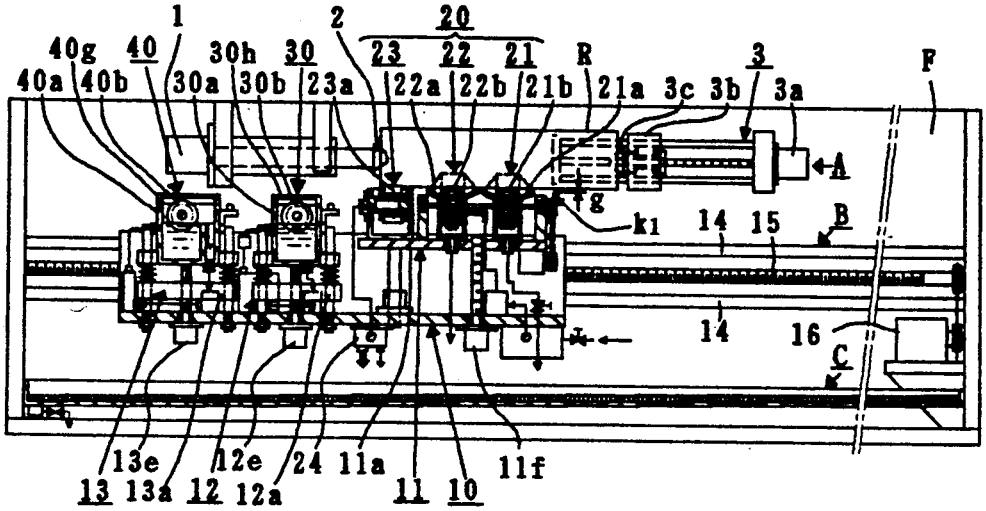
FIG. 1 is a schematic front view which illustrates one embodiment of the photosensitive film coating device for plate rolls of the present invention, especially showing a pretreatment process.
Figure 2:
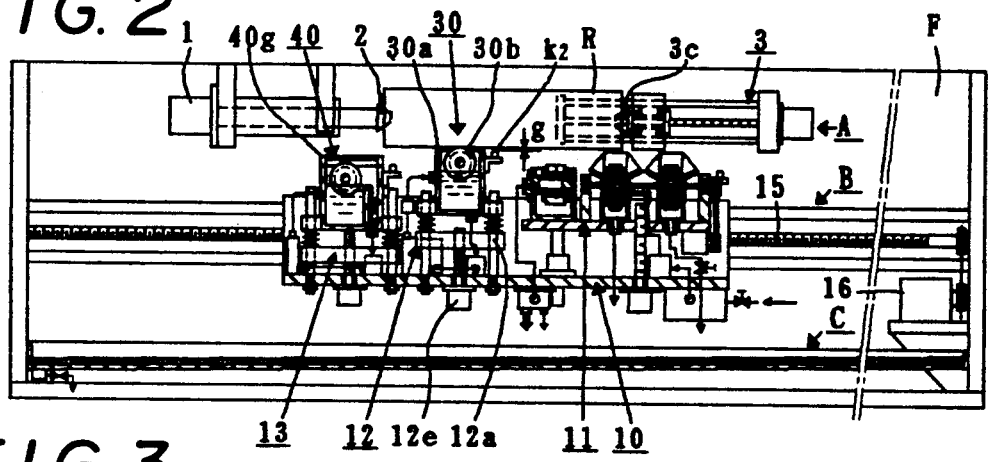
FIG. 2 is a schematic front view thereof, showing the photosensitive film coating process.
Figure 3:
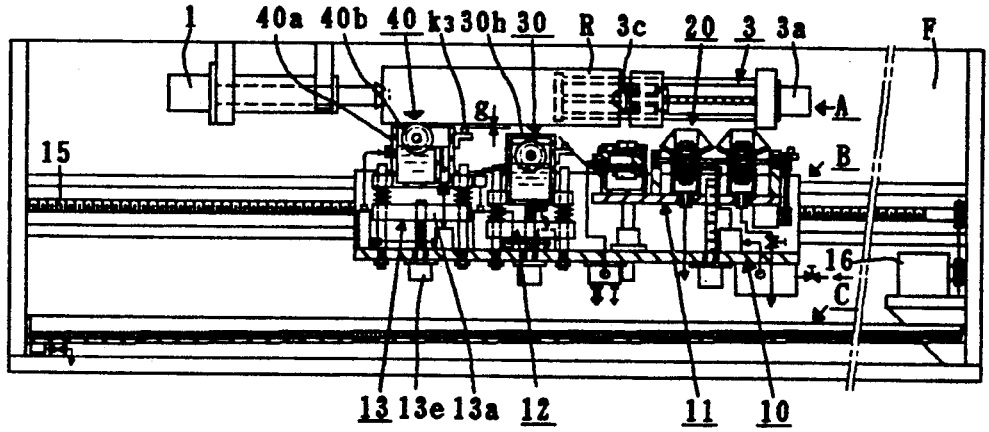
FIG. 3 is a schematic front view thereof, showing the protective film coating process.

First, a constitution of the device will be described:

As is shown in FIGS. 1 through 3, the photosensitive film coating device for plate rolls includes; (i) a plate roll chucking and rotating means A (hereinafter referred to as a "chucking means A") that holds a plate roll R at both ends in a horizontal position and causes the plate roll R to rotate at a predetermined speed, (ii) a multi-surface-treatment means B (hereinafter referred to as a "treatment means B") that is located beneath the chucking means A and alternately performs a pretreatment, a photosensitive film coating treatment, and a protective film coating treatment on the plate roll R, and (iii) a drain pan C which is located beneath the treatment means B. These three basic elements are installed in a frame F consisting of a floor plate, left and right side plates and a front plate.

The chucking means A consists of a spindle chuck 2 which is rotatably driven by a first motor 1, and an X table device 3 which is composed of a second motor 3*a*, an X table 3*b*, and a tail chuck 3*c*. The tail chuck 3*c* is rotatably provided on the X table 3*b*, and the X table 3*b* is slid on the X table device 3 by means of the second motor 3*a*.

The thus comprised chucking means A holds the both ends of the plate roll R in a horizontal position and rotates the plate roll R at a predetermined speed. For example, the circumferential speed of the plate roll R is set at 0.3 mm/sec.

The treatment means B consists of three separate table devices 11, 12, and 13. The three separate table are installed on a common table 10, and alternately raised and lowered in the perpendicular direction. The common table 10 installed beneath the plate roll R is capable of performing a reciprocating motion in the direction of the length of the plate roll.

On the three separate table devices 11, 12, and 13, a pretreatment means 20, a photosensitive film coating means 30, and a protective film coating means 40 are respectively installed.

A first proximity sensor k1, a second proximity sensor k2, and a third proximity sensor k3 are respectively provided on the three separate table devices 11, 12, and 13 so as to detect the both ends of the plate roll and a gap (g) between the sensors and the surface of the plate roll R.

The common table 10 is L shaped, and a linear guide (not shown) is installed on the back surface of the vertical part of the common table 10. The linear guide is engaged with and guided by a horizontal guide 14. A nut runner (not shown), that is also installed on the back surface of the vertical part of the common table 10, is engaged with a screw shaft 15 rotatably driven by a third motor 16 so that the common table 10 is caused to move back and forth.

The third motor 16 is driven so that the common table 10 is caused to move forward (i.e., move to the left in the drawings) after each of the first, second, and third proximity sensors detect the gap (g) between each of the sensors and one end (i.e., the spindle-chuck end) of the plate roll R.

The third motor is stopped when the common table device 10 moves a predetermined distance in the forward direction after the other end (i.e., the tail-chuck end) of the plate roll is detected by each of the first, second, and third proximity sensors.

Then, after a predetermined period of time has elapsed, the third motor reversely rotates so that the common table device 10 is caused to move a predetermined return stroke.

Figure 4:
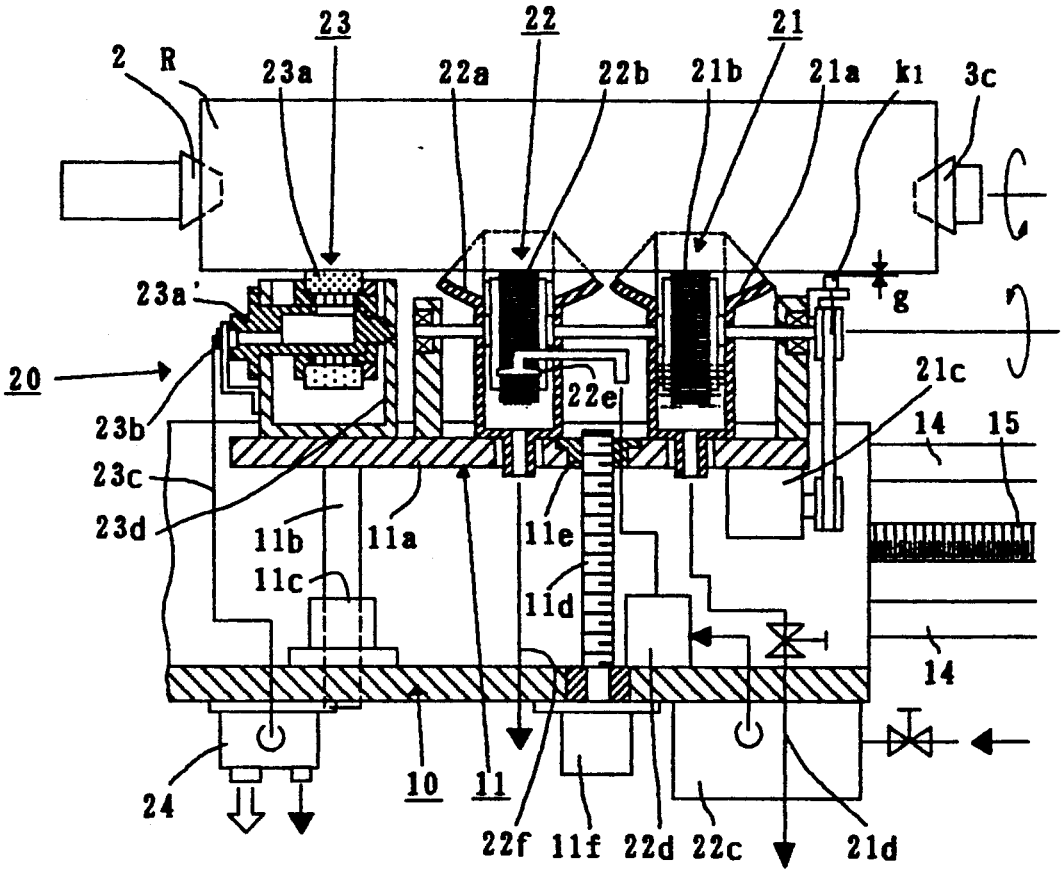
FIG. 4 is an enlarged front view of the essential parts illustrating the pretreatment process.

As is shown in FIG. 4, the first separate table device 11 is comprised of a table 11*a*, a rod 11*b*, a tube-form guide 11*c* that is provided on the common table 10, a nut 11*e* that is fastened to the table 11*a*, a screw shaft 11*d* engaged with the nut 11*e*, and a fourth motor 11*f* that is provided on the under surface of the common table 10.

The rod 11*b*, which is vertically installed on the under surface of the table 11*a*, passes through the tube-form guide 11*c*. The screw shaft 11*d*, which is supported on the common table 10, is rotatably driven by the fourth motor 11*f*.

With such a structure, the table 11*a* is moved upward and downward by the fourth motor 11*f*.

The pretreatment means 20 consists of (i) a cleaning means 21 which performs a cleaning of the plate roll R, (ii) a brush type water rinsing means 22 (hereinafter referred to as a rinsing means) which performs a water rinsing operation following the cleaning operation, and (iii) a sponge plate roll contact type moisture removal means 23 (hereinafter referred to as a moisture removal means) which removes moisture from the plate roll R after the water rinsing operation. These three means 21, 22 and 23 are installed on the table 11*a* of the first separate table device 11.

The cleaning means 21 performs a cleaning operation by bringing a first brush roll 21*b*, which is immersed in a cleaning agent (neutral detergent) in a first mini-tank 21*a*, into contact with the plate roll R while the brush roll 21*b* is rotated by a seventh motor 21*c* installed on the table 11*a*.

The cleaning agent in the first mini-tank 21*a* is replenished when the amount drops below a predetermined level or when the cleaning capacity of the cleaning agent decreases. A valve-equipped drain outlet 21*d* is installed in the first mini-tank 21*a* for replacement of the cleaning agent.

The rinsing means 22 performs a water rinsing operation by causing a second brush roll 22*b* being rotated by the seventh motor 21*c* and having bristles washed by washing water contained in a second mini-tank 22*a* to contact with the portion of the plate roll R that has been subjected to the cleaning operation. Tap water is used for washing the second brush roll 22*b* that is introduced into a hot water production tank 22*c* installed on the common table 10; wherein the tap water is heated to a predetermined temperature. The thus heated water is pumped upwardly by a pump 22d via a hose and sprayed onto the bristles of the second brush roll 22b by a shower nozzle 22e. The water in the second mini-tank 22a is discharged via a drain outlet 22f and flows downward into the drain pan C.

The moisture removal means 23 is comprised of a sponge roll 23a, a hollow shaft 23a', a rotary joint tube 23b, a hose 23c, a bracket 23d, and a moisture removal device 24 which is, for example, an air suction means. The sponge roll 23a is provided on outer circumference of the hollow shaft 23a' that is supported by the bracket 23d at the both ends. The open end of the hollow shaft 23a' is connected to the moisture removal device 24 installed on the under surface of the common table 10. The hollow shaft 23a' has an opening on the circumference of the hollow shaft so that air is sucked into the hollow part of the hollow shaft 23a' from outer circumference of the sponge roll 23a by means of the moisture removal device 24.

The sponge roll 23a is brought into contact with the portion of the plate roll R that has been subjected to the water rinsing operation.

As a result of this contact, the sponge roll 23a is caused to undergo a passive rotation. The moisture adhering to the plate roll R is sucked into the interior of the sponge roll 23a along with air by the suction action of the moisture removal device 24. The moisture thus captured by the moisture removal device 24 flows down into the drain pan C.

Figure 5:
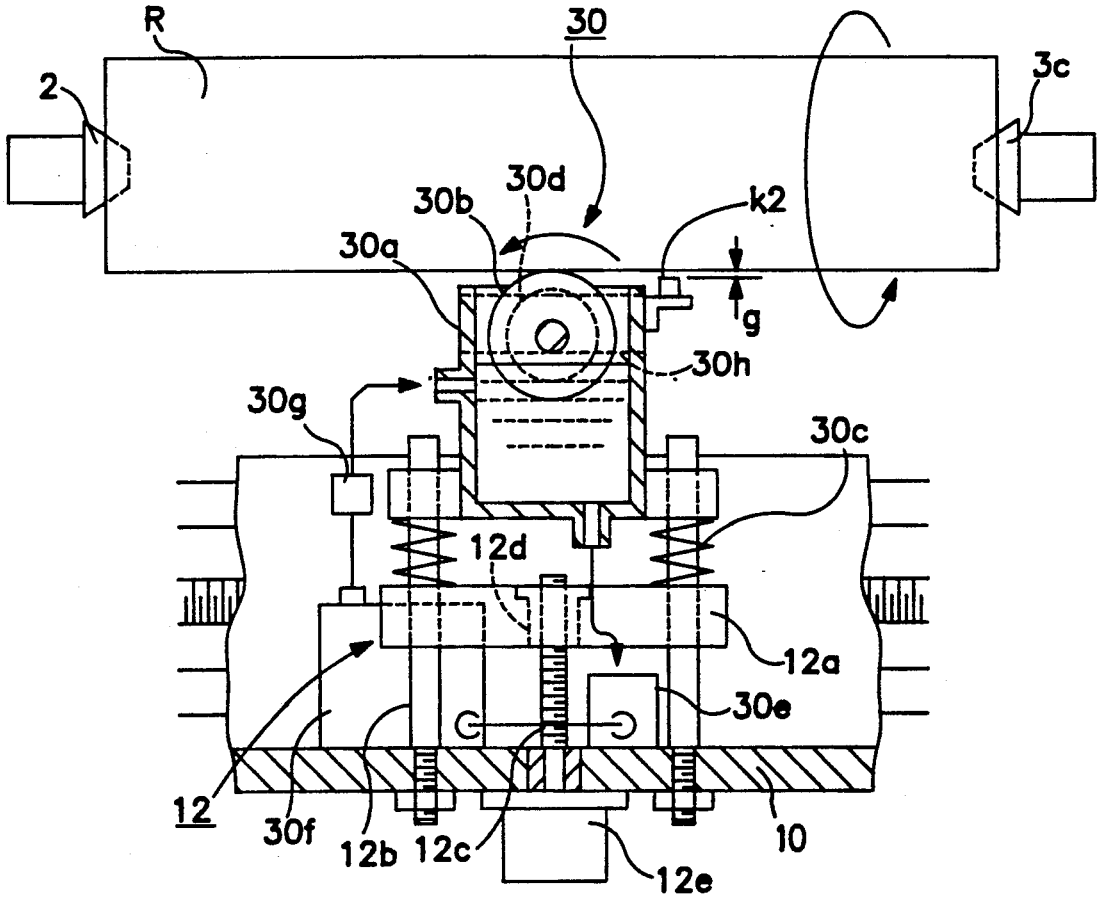
FIG. 5 is an enlarged front view of the essential parts illustrating the photosensitive film coating process.

As is shown in FIG. 5, the second separate table device 12 includes a table 12a, rods 12b, a screw shaft 12c, a nut 12d, and fifth motor 12e.

The table 12a, which is guided by the rods 12b vertically provided on the common table 10, is supported by the screw shaft 12c by means of the nut 12d. The screw shaft 12c is rotatably driven by the fifth motor 12e installed on the under surface of the common table so that the table 12a is raised and lowered.

The photosensitive film coating means 30 consists of a third mini-tank 30a which is provided on the table 12a by means of springs 30c, a photosensitive film coating roll 30b which is installed inside the third mini-tank 30a, and an eighth motor 30d which is provided on the outside of the third mini-tank 30a.

A circulation system of the photosensitive film coating means is composed of a pump 30e, an auxiliary tank 30f, and a filter 30g. Photosensitive liquid stored in the third mini-tank is circulated for several minutes, for example, approximately 10 minutes, before the photosensitive film coating treatment so that the photosensitive liquid is agitated and air bubbles contained in the liquid float are eliminated by letting the air bubbles float upwardly.

Accordingly, the photosensitive liquid is maintained in a uniform state. This circulation of the photosensitive liquid is not performed during the coating operation.

The third mini-tank 30a has a lid 30h which can seal the opening of the third mini-tank 30a. When the coating operation is initiated, the lid 30h is automatically opened, and when the coating operation is completed, the lid 30h is automatically closed.

The photosensitive film coating roll 30b is caused to rotate in contact with the plate roll R such that (i) the axial direction of the photosensitive film coating roll 30b crosses the axial direction of the plate roll R, and (ii) the photosensitive liquid carried on the surface of the photosensitive film coating roll 30b faces the direction of the advancement of the common table 10.

Accordingly, the photosensitive film is coated in the form of spiral, and the adjacent tracks of the spiral are caused to overlap by 70 to 90%, so that a rubbed-in coating is completely performed. In this way, the generation of pinholes where the photosensitive film is not coated is completely avoided. Thus, a photosensitive film with a uniform thickness is coated in an continuous manner along the entire length of the plate roll R.

The photosensitive film coating roll 30b, which is made by foaming a resin such as polyvinyl alcohol, etc., is driven at a predetermined speed, for example, 60 rpm. The size of the photosensitive film coating roll is, for example, 130 mm in diameter and 35 mm in the length. In such a condition, the transit speed of the common table 10 in a horizontal direction is determined so that a finished width is, for example, approximately 7 mm per rotation of the plate roll.

Figure 6:
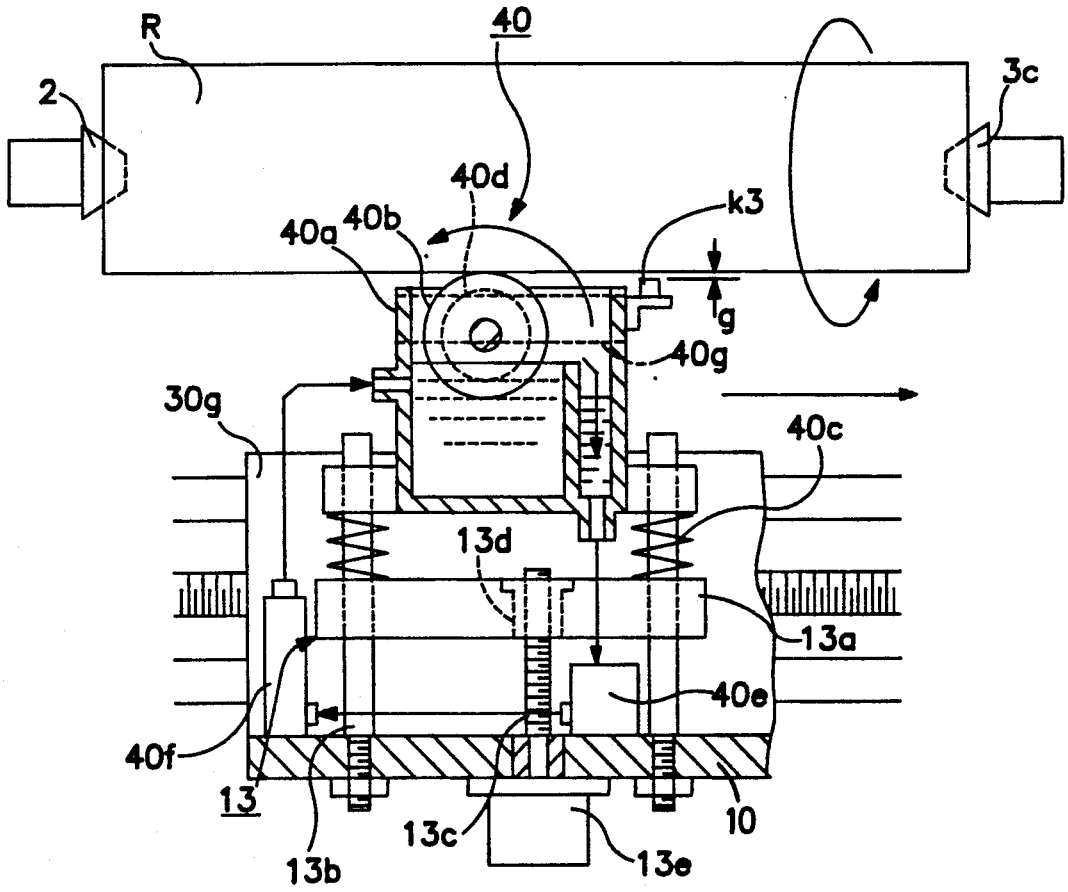
FIG. 6 is an enlarged front view of the essential parts illustrating the protective film coating process.

FIG. 6 shows the third separate table device 13 that is comprised of a table 13a, rods 13b, a screw shaft 13c, a nut 13d, and a sixth motor 13e.

The table 12a, which is guided by the rods 13b vertically provided on the common table 10, is supported by the screw shaft 13c by means of the nut 13d. The screw shaft 13c is rotatably driven by the sixth motor 13e installed on the under surface of the common table, so that the table 13a is raised and lowered.

The protective film coating means 40 consists of a fourth mini-tank 40a (constructed with an over flow structure), a protective film coating roll 40b, springs 40c, and a ninth motor 40d.

The fourth mini-tank 40a, which is provided on the table 13a via the springs 40c, is supported along the rods 13b of the third separate table. The protective film coating roll 40b installed in the fourth mini-tank 40a is driven by the ninth motor 40d provided outside the fourth mini-tank 40a.

A circulation system of the photosensitive film coating means 40 is composed of a pump 40e and a filter 40f.

The photosensitive protective film liquid (hereinafter referred to as "protective liquid"), which is stored in the fourth mini-tank 40a and its over-flow tank, is circulated for several minutes before the protective film coating treatment till the end of this treatment. Accordingly, the protective liquid is agitated and kept in a uniform state.

The protective liquid is a transparent macromolecules agent such as polyvinyl alcohol, etc., which shows an oxygen-blocking effect when stiffened.

The protective film is used so as to maintain an original sensitivity of the photosensitive film.

The fourth mini-tank 40a has a lid 40g which can seal the opening of the fourth mini-tank 40a. When the coating operation is initiated, the lid 40g is automatically opened, and when the coating operation is completed, the lid 40g is automatically closed.

The protective film coating roll 40b is caused to rotate in contact with the plate roll R such that (i) the axial direction of the protective film coating roll 40b crosses the axial direction of the plate roll R, and (ii) the carrying of the protective liquid on the protective film coating roll 40b occurs on the forward side of the roll 40b with respect to the direction of the advancement of the common table 10.

Accordingly, a transparent protective film is coated in the form of a spiral, and the adjacent tracks of the spiral overlap by 70 to 90%, so that a rubbed-in coating is thoroughly accomplished. In this way, the generation of pinholes where the protective film is not coated is completely avoided, and a protective film with a uniform thickness is applied in a continuous manner along the entire length of the plate roll R.

The protective film coating roll 40b, which is also made by foaming a resin such as polyvinyl alcohol, etc., is driven at a predetermined speed, for example, 60 rpm. The size of the protective film coating roll is, for example, 130 mm in diameter and 35 mm in the length. In such a condition, the transit speed of the common table 10 in a horizontal direction is determined so that a finished width is, for example, approximately 7 mm per rotation of the plate roll R.

Next, the operation of the embodiment of the photosensitive film coating device for plate rolls, that are to be made into printing plates, provided by the present invention will be described:

The plate roll R is positioned horizontally between the spindle chuck 2 and the tail chuck 3. When a "chucking start" button (not shown) is pressed, the second motor 3a is driven, and the plate roll R is held at both ends by the spindle chuck 2 and tail chuck 3.

When the "operation start" button (not shown) is pressed, the pretreatment, photosensitive film coating treatment and protective film coating treatment are automatically performed in that order.

First, the pretreatment is initiated as shown in FIG. 1. The detail is shown in FIG. 4. The first motor 1 is driven and the plate roll R is rotated. The rotation of the plate roll R is continued throughout the entire operation and for approximately an additional 10 minutes following the completion of the protective film coating treatment.

Prior to the initiation of the pretreatment, the first brush roll 21b is set at the initial position that corresponds to one end of the plate roll R. The seventh motor 21c is driven so that the first brush roll 21b and second brush roll 22b are caused to rotate, and air suction action of the moisture removal device 24 is started.

Then, the fourth motor 11f is driven so that the table 11a is elevated and the first brush roll 21b appropriately contacts the surface of the end of the plate roll R.

When the first brush roll 21b contacts the surface of the plate roll R, the first proximity sensor k1 detects the gap between the sensor k1 and the surface of the plate roll R, and the fourth motor is stopped by the signal from the first proximity sensor k1.

Then the third motor 16 is driven by the signal from the first proximity sensor k1 so that the common table device 10 is moves toward the other end of the plate roll R. Thus, the second brush roll 22b rotates in contact with the plate roll R following the first brush roll 21b, and the sponge plate roll 23a rotates in contact with the plate roll R following the second brush roll 22b.

The first brush roll 21b and the second brush roll 22b rotate against the plate roll R, while the sponge plate roll 23a rotates passively with the plate roll R. The first brush roll 21b applies the cleaning agent in the first mini-tank 21a to the surface of the plate roll R in a spiral pattern without remaining any gaps, so that the entire surface of the plate roll R is subjected to a continuous cleaning process. Any cleaning agent scattered in this process is retrieved inside the first mini-tank 21a through the top opening.

The second brush roll 22b rinses with water the operation on the portion of the plate roll R that has been subjected to the cleaning operation.

During this rinsing operation, the bristles of the second brush roll 22b are washed by the washing water stored in the second mini-tank 22a. Any water scattered in this process is recovered in the second mini-tank 22a through the top opening.

The sponge plate roll 23a performs a moisture removal operation via an air suction by the moisture removal means 24 on the portion of the plate roll R that has been subjected to the water rinsing operation.

The common table device 10 moves to the right (in the drawings), and when the first proximity sensor k1 passes the other end of the plate roll R, the first proximity sensor k1 detects the other end of the plate roll R. The third motor 16 continues to rotate for a predetermined number of revolutions after the end of the plate roll is detected and until the sponge roll 23a reaches the other end of the plate roll R. The pretreatment is thus completed.

Next, the seventh motor 21c and the moisture removal device 24 are stopped, the pretreatment means 20 is moved back to the initial position by the reverse rotation of the fourth motor 11f, and the third motor 16 reversely rotates until the photosensitive film coating roll 30b reaches a position corresponding to the end of the plate roll R.

Next, the photosensitive film coating treatment is initiated as shown in FIG. 2. The detail is shown in FIG. 5.

The pump 30e is driven for several minutes from the initiation of the pretreatment to an intermediate point of the pretreatment process so that the photosensitive liquid is circulated through the circulation system, after which the liquid is left as is for several minutes. As a result, air bubbles in the photosensitive liquid contained in the third mini-tank 30a float upward and eliminated. The photosensitive liquid is thus maintained in a uniform state.

The lid 30h is then automatically opened, and the photosensitive film coating roll 30b is rotated by the eighth motor 30b, and the fifth motor 12e is driven to elevate the table 12a. At the point where the photosensitive film coating roll 30b is placed in an appropriate contact with one end of the plate roll R, the second proximity sensor k2 detects the gap (g) between itself and the surface of the plate roll R, the fifth motor 12e is stopped by a signal generated by the second proximity sensor k2, and the third motor 16 is driven by the signal of the second proximity sensor k2 so that the common table device 10 is caused to move toward the other end of the plate roll R.

Next, the photosensitive film coating roll 30b is caused to rotate in contact with the plate roll R such that (i) the axial direction of the photosensitive film coating roll 30b crosses the axial direction of the plate roll R, and (ii) the carrying of the photosensitive liquid on the photosensitive film coating roll 30b occurs on the forward side of the plate roll 30b with respect to the direction of the advancement of the plate roll 30b.

As a result, the photosensitive film is coated in the form of a spiral, and adjacent tracks of this spiral are caused to overlap by 70 to 90%, so that a rubbed-in coating is thoroughly coated.

Accordingly, the generation of pinholes where the photosensitive film is not applied is completely avoided, and a photosensitive film with a uniform thickness is coated in an continuous manner along the entire length of the plate roll R.

The common table device 10 moves to the right in the drawings, and when the second proximity sensor k2 passes the other end of the plate roll R, the sensor k2 detects the other end of the plate roll R. The third motor 16 makes a predetermined number of revolutions after the end of the plate roll is detected, and when the photosensitive film coating roll 30*b* reaches the other end of the plate roll R, the third motor 16 is stopped.

Subsequently, the eighth motor 30*d* is stopped, and the photosensitive film coating means 30 is moved back to the initial position by the reverse rotation of the fifth motor 12*e*. After the lid is automatically closed, the third motor 16 reversely rotates until the protective film coating roll 40*b* reaches a position corresponding to the end of the plate roll R.

The photosensitive film coating treatment is thus completed.

Following the completion of the photosensitive film coating treatment, the photosensitive film dries for approximately 10 minutes. After this drying time has passed, the protective film coating treatment is initiated as shown in FIG. 3. The detail is shown in FIG. 6.

The plate roll R is kept rotating between the completion of the photosensitive film coating treatment and the initiation of the protective film coating treatment, so that there is no bias in the thickness of the photosensitive film.

A few minutes prior to the completion of the photosensitive film coating treatment, the pump 40*e* of the protective film coating means 40 is driven so that the protective liquid is circulated through the circulation system.

In this way, the protective liquid in the fourth mini-tank 40*a* is maintained in a uniform state. The lid 40*g* is automatically opened, and the ninth motor 40*d* is driven so that the protective film coating roll 40*b* is caused to rotate.

Furthermore, the sixth motor 13*e* is driven to raise the table 13*a*. At the point where the protective film coating roll 40*b* is placed in an appropriate contact with one end of the plate roll R, the third proximity sensor k3 detects the gag (g) between itself and the surface of the plate roll R, and the sixth motor 13*e* is stopped by a signal generated by the third proximity sensor k3.

As a result of this signal, the third motor 16 is driven so that the common table device 10 is caused to move toward the other end of the plate roll R. A protective film is thus coated on the plate roll R. In this case, the protective film coating roll 40*b* is caused to rotate in contact with the plate roll R such that (i) the axial direction of the protective film coating roll 40*b* crosses the axial direction of the plate roll R, and (ii) the carrying of the protective liquid on the protective film coating roll 40*b* occurs on the forward side of coating roll 40*b* with respect to the direction of the advancement of the roll 40*b*.

As a result, the protective film is coated in the form of a spiral, and adjacent tracks of this spiral are caused to overlap, so that a rubbed-in coating is thoroughly coated.

Accordingly, the generation of pinholes where no coating is applied is completely avoided, and a protective film with a uniform thickness is applied in an continuous manner along the entire length of the plate roll R.

The common table device 10 moves to the right in the drawings, and when the third proximity sensor k3 passes the other end of the plate roll R, the third proximity sensor k3 detects the other end of the plate roll R. The third motor 16 makes a predetermined number of revolutions after the end of the plate roll is detected. When the protective coating roll 40*b* reaches the other end of the plate roll R, the third motor 16 is stopped, and the protective film coating means 40 is moved back to the initial position by the reverse rotation of the sixth motor 13*e*. After the lid is automatically closed, the third motor 16 reversely rotates until the first brush roll 21*b* of the cleaning means 21 of the pretreatment means 20 reaches at a position corresponding to the end of the plate roll R.

As seen in the above, the pretreatment, the photosensitive film coating treatment and the protective film coating treatment are performed in a completely automatic manner.

The plate roll R is rotated for approximately 10 minutes following the completion of the protective film coating treatment, so that no bias is generated in the thickness of the protective film.

Approximately 10 minutes after the protective film is dried, the plate roll R is released from the chucks and subjected to a laser exposure.

In the present invention, since a pretreatment, a photosensitive film coating, and a protective film coating are performed by a single device, the device does not occupy a large space, and the price of the device is lower than conventional devices.

In addition, the plate roll is successively 'scanned' by the three means, i.e., the pretreatment means, the photosensitive film coating means, and the protective film coating means. Therefore, the device can make plate rolls which are coated by the photosensitive film and protective film with a uniform thickness.

Furthermore, according to the present invention, it is not necessary to replace the plate roll each time the pretreatment, the photosensitive film coating and the protective film coating are performed, so that it takes a few handling time and labor.

I claim:

1. A photosensitive film coating device for plate rolls that are to be made into printing plates characterized in that said photosensitive film coating device comprises:

a plate roll chucking and rotating means which chucks the plate roll at both ends in a horizontal position and rotates said plate roll at prescribed rpm, and a multi-surface-treatment means which alternately performs a pretreatment, a photosensitive film coating treatment and a protective film coating treatment, wherein, said multi-surface-treatment means has three separate table devices which can be alternately raised and lowered, said means being installed on a single common table device which is positioned beneath said plate roll and is capable of making a reciprocating motion in the direction of the length of the plate roll surface, a pretreatment means, a photosensitive film coating means and a protective film coating means are respectively installed on three separate table devices, said pretreatment means consists of a cleaning means which performs a cleaning operation by causing a first brush roll which is immersed in a cleaning agent contained in a first mini-tank to contact the plate roll, a brush type water rinsing means which performs a water rinsing operation by causing a second brush roll whose bristles are washed by washing water inside a second mini-tank to contact the portion of the plate roll that has been subjected to the cleaning operation, and a sponge plate roll contact type moisture removal means which performs a moisture removal operation by causing a sponge plate roll, which is connected to an air suction means so that air suction can be created from the surface of said sponge plate roll toward the interior of said sponge plate roll, to contact the portion of the plate roll that has been subjected to the water rinsing operation, said photosensitive film coating means by causing a photosensitive film coating roll immersed in a photosensitive liquid contained in a third mini-tank to rotate in contact with the plate roll in such a manner that the longitudinal axial direction of said photosensitive film coating roll crosses the longitudinal axial direction of the plate roll that is to be made into a printing plate as seen in a plan view, and the carrying of said photosensitive liquid on the photosensitive film coating roll occurs on the forward side of said coating roll with respect to the direction of advance of said coating roll, and said protective film coating means is designed so that it applies a protective film by causing a protective film coating roll immersed in a transparent photosensitive film protective liquid contained in a fourth mini-tank to rotate in contact with the plate roll in such a manner that the longitudinal axial direction of the protective film coating roll crosses the longitudinal axial direction of the plate roll that is to be made into a printing plate as seen in a plan view, and the carrying of the photosensitive film protective liquid on the protective film coating roll occurs on the forward side of said coating roll with respect to the direction of advance of said coating roll.

2. A photosensitive film coating device for a plate roll comprising;

a roll chucking means comprised of a spindle chuck, a tail chuck and motors, said means holding and rotating said plate roll, and a multi-treatment-means comprised of a pretreatment means, a photosensitive film coating means and a protective film coating means which are respectively provided on three separate table devices that can be raised and lowered relative to said plate roll, and means for translating said table devices in a reciprocating motion in the direction of the length of the plate roll surface, wherein said pretreatment means comprises a cleaning means, a rinsing means and a moisture removal means, said pretreatment means consecutively cleaning on said plate roll, rinsing on said plate roll and then removing a moisture from said plate roll, as another of said table devices with said pretreatment means thereon is translated, said photosensitive film coating means consists of a photosensitive film coating roll and a photosensitive liquid tank, said coating means coating photosensitive liquid on said plate roll following a pretreatment operation performed by said pretreatment means, as another of said table devices with said photosensitive film coating means thereon is translated, and said protective film coating means consists of a protective film coating roll and a protective liquid tank, said coating means coating protective liquid on said plate roll following a photosensitive liquid coating operation performed by said photosensitive film coating means, as another of said table devices with said protective film coating means thereon is translated.

3. A photosensitive film coating device according to claim 2 wherein said spindle chuck is connected to one of said motors, and said tail chuck is rotatably provided on an X table which is installed on a X table device so as to be slid by the other of said motors so that said plate roll is horizontally held between said spindle chuck and said tail chuck and rotated at a predetermined speed.

4. A photosensitive film coating device according to claim 2 wherein said cleaning means is comprised of a mini-tank in which a cleaning agent is stored and a first brush immersed in said cleaning agent so that a cleaning of said plate roll is performed by causing said first brush to contact said plate roll.

5. A photosensitive film coating device according to claim 2 wherein said rinsing means is comprised of a mini tank in which a rinsing water is stored and a second brush immersed in said rinsing water so that a rinsing of said plate roll is performed by causing said second brush to contact said plate roll.

6. A photosensitive film coating device according to claim 2 wherein said moisture removal means is comprised of a sponge roll, a hollow shaft and a moisture removal device, said sponge roll being connected to said moisture removal device by means of said hollow shaft so that a moisture removing of said plate roll is performed by causing said sponge roll to contact said plate roll.

7. A photosensitive film coating device according to claim 2 wherein said photosensitive film coating roll is contacted and rotated with said plate roll such that the longitudinal axial direction of said photosensitive film coating roll crosses the longitudinal axial direction of said plate roll, and a carrying of said photosensitive liquid on said photosensitive film coating roll occurs on a forward side of said photosensitive film coating roll with respect to the direction of advancement of said photosensitive film coating roll.

8. A photosensitive film coating device according to claim 2 wherein said protective film coating roll is contacted and rotated with said plate roll such that the longitudinal axial direction of said protective film coating roll crosses the longitudinal axial direction of said plate roll, and a carrying of said protective liquid on said protective film coating roll occurs on a forward side of said protective film coating roll with respect to the direction of advancement of said protective film coating roll.

* * * * *